United States Patent [19]

Anderson

[11] 3,933,278

[45] Jan. 20, 1976

[54] CHILD-SAFE CONTAINER ASSEMBLY

[75] Inventor: Victor F. Anderson, Wenonah, N.J.

[73] Assignee: Shell Oil Company, Houston, Tex.

[22] Filed: Sept. 23, 1974

[21] Appl. No.: 508,375

[52] U.S. Cl. ..... 222/182

[51] Int. Cl.[2] ..... B65D 83/14

[58] Field of Search ... 222/153, 182, 402.1, 402.11, 222/402.12, 402.13, 402.14, 402.15; 220/306; 137/382; 49/390–392

[56] References Cited

UNITED STATES PATENTS

| | | | |
|---|---|---|---|
| 3,137,414 | 6/1964 | Steinkamp | 222/402.14 |
| 3,146,916 | 9/1964 | Kronheim | 222/402.15 |
| 3,712,515 | 1/1973 | Corll | 222/182 |
| 3,770,168 | 11/1973 | Sagarin | 222/182 |

*Primary Examiner*—Stanley H. Tollberg

[57] ABSTRACT

A child-safe container assembly having closure accessible through an elongated passageway, and further characterized by a pivotally supported damper-like member which normally obstructs the passageway, and adapted for the finger of a user to be inserted into the passageway in order to first move the damper-like member at least partially out of the way and thereafter to actuate the closure for releasing contents from the container.

5 Claims, 11 Drawing Figures

CHILD-SAFE CONTAINER ASSEMBLY

BACKGROUND OF THE INVENTION

The use of single-finger entry containers which can be actuated by the finger of an adult for the release of contents therefrom, but cannot be actuated by the finger of a young child, is well-known and is shown for example in the Corll Pat. No. 3,712,515. The success of this type of safety device is based upon the assumption that the length of a passageway, in and or itself, will successfully prevent a small child from releasing contents from the container.

The type of device referred to above is being successfully used at the present time and is generally thought to be satisfactory for its intended purposes. It is used particularly in aerosol containers which are used for dispensing chemical materials of a poisonous or harmful nature. It may also be used on other types of containers having other types of contents.

There is little if any evidence at the present time to suggest that the use of the elongated passageway to successfully discriminate between an adult user of the container and a small child would be anything but successful. However, the present invention is based upon the premise that a somewhat different approach to the problem may provide a better overall result.

SUMMARY OF THE INVENTION

According to the present invention a container is provided which has an elongated passageway communicating with its closure means, and the length of the passageway is intended to prevent or at least discourage the opening of the container by a small child. In addition thereto, however, the present invention provides a removable obstruction in the passageway, which must be moved at least partially out of the way by the finger of the user in order to obtain access to the container contents. The presently preferred form of the invention incorporates a damper-like member which is pivotally supported from one wall of the passageway.

DRAWING SUMMARY

PREFERRED EMBODIMENT

Figure 1:
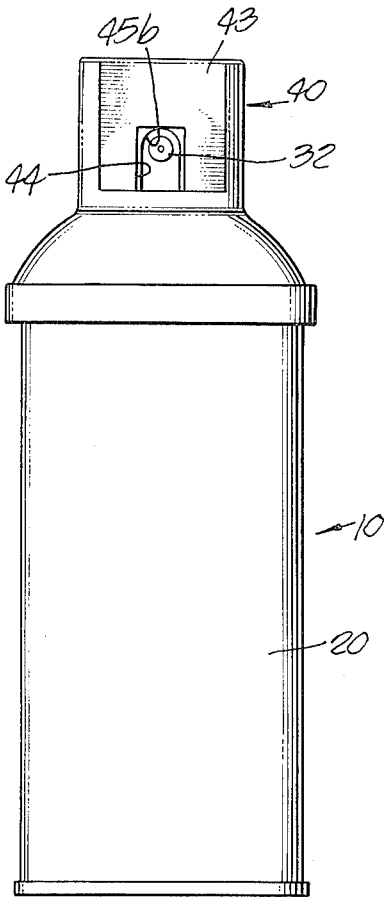
FIG. 1 is a front elevation view of the presently preferred form of the invention.
Figure 2:
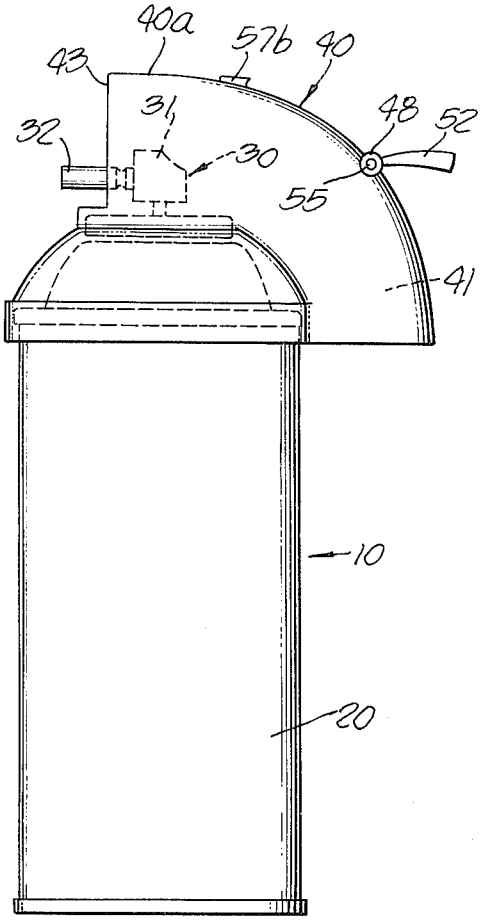
FIG. 2 is a side elevation view.

Reference is now made to FIGS. 1 through 9, inclusive, of the drawings which illustrate the presently preferred form of the invention.

The container assembly 10 includes a cylindrical metal container 20 having closure means 30 associated with the upper end thereof. The closure means 30 is substantially fully enclosed by a cover means 40. The illustrated container assembly is an aerosol package in which the closure means 30 includes a valve actuator 31 and a dispensing nozzle 32.

Figure 4:
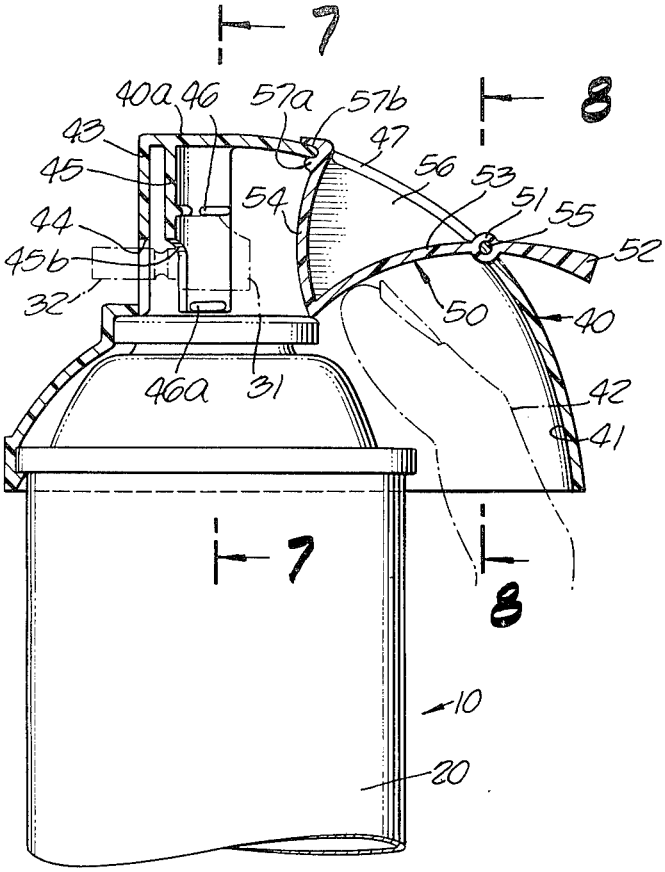
FIG. 4 is an elevation view, partially in cross-section.
Figure 5:
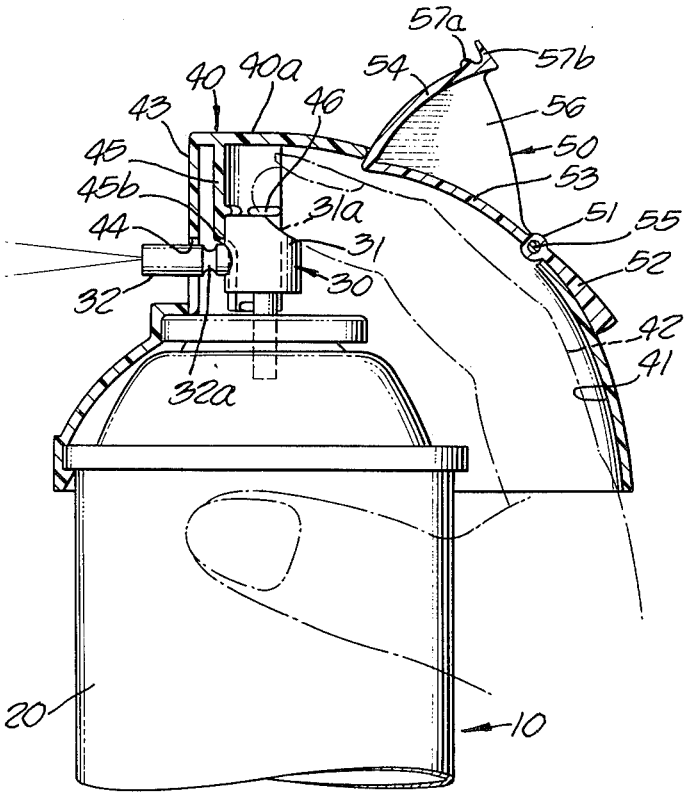
FIG. 5 is a view like FIG. 4 showing the operation of the device.

As best seen in FIGS. 4 and 5, the cover 40 defines an elongated passageway 41 which is adapted to be entered by the single finger 42 of a user of the aerosol package. The elongated passageway 41 is very similar to that shown in the Corll Pat. No. 3,715,515 referred to above.

The internal end of passageway 41 communicates with the valve actuator 31, and hence when the finger of the user has entered the full length of the passageway 41 it is possible to engage and actuate the valve actuator 31 and thereby dispense a liquid spray through the dispensing nozzle 32. This mode of construction and operation is, in general, well known in the art.

Figure 3:
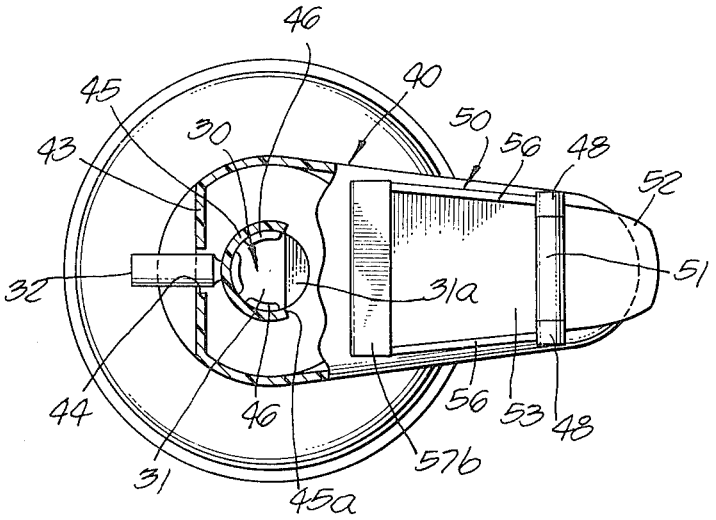
FIG. 3 is a top plan view, partially in cross-section.
Figure 6:
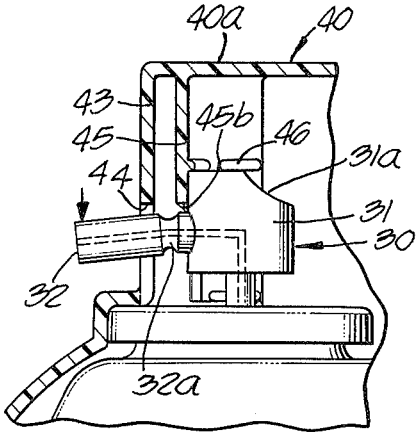
FIG. 6 is a fragmentary cross-sectional view further illustrating the operation of the device.
Figure 7:
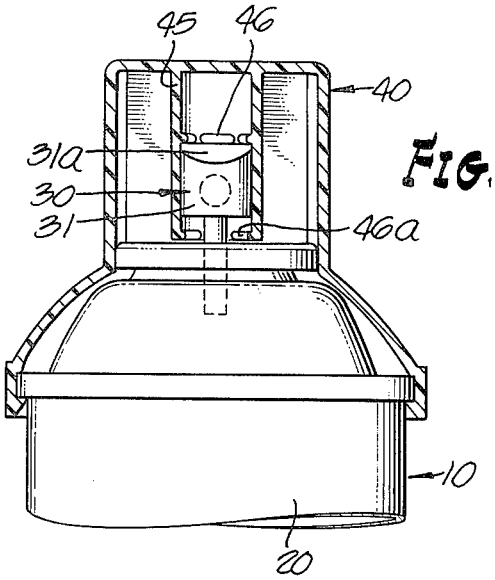
FIG. 7 is a fragmentary cross-sectional view taken on the line 7—7 of FIG. 4.
Figure 8:
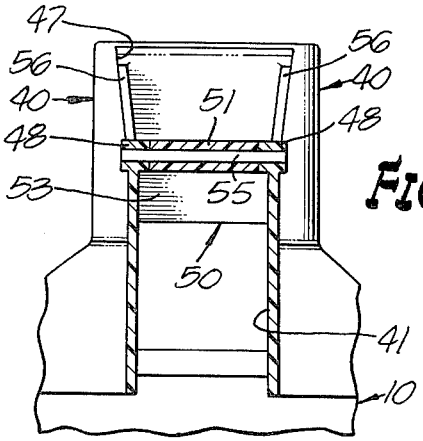
FIG. 8 is a fragmentary cross-sectional view taken on the line 8—8 of FIG. 4.
Figure 9:
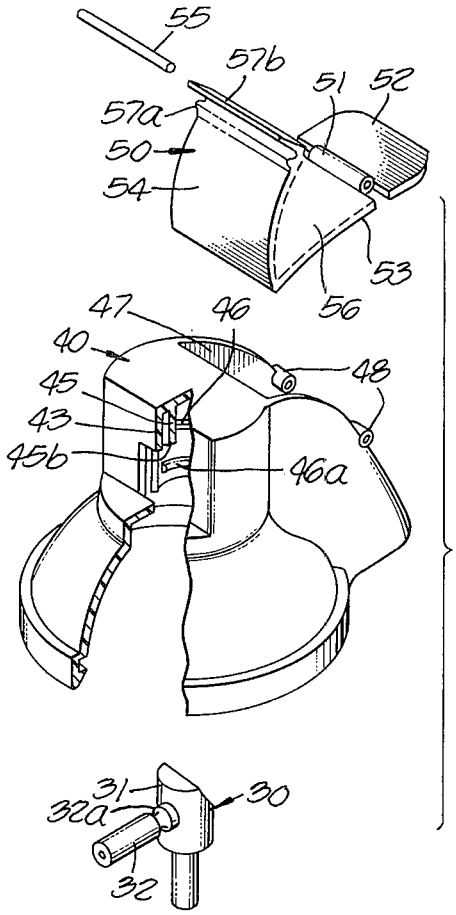
FIG. 9 is an exploded perspective view partially in cross-section of the container cover.

A specific novel feature of the present invention as best seen in FIGS. 3, 6 and 7 is that structure of cover 40 is provided with a dual wall for guiding the movements of the valve actuator 31 and nozzle 32. Specifically, an outer or forward wall portion 43 has a vertical window 44 formed therein through which the dispensing nozzle 32 projects in perpendicular relationship to the window, and the exterior wall 43 effectively prevents access to the valve actuator 31 from outside the container on its forward side. Moreover, application of downward pressure on the projecting end of the dispensing nozzle 32, as illustrated in FIG. 6, is ineffective to move the valve actuator 31. Cover 40 also has an interior wall 45 located in a generally parallel relationship to the exterior wall 43. However, where the exterior wall 43 is a flat wall having a flat window opening 44 therein, the interior wall 45 has a generally cylindrical configuration within which the generally cylindrical valve actuator member 31 is received. More specifically, the interior wall 45 extends around somewhat more than 180° of the circumference of the valve actuator 31, and the valve actuator 31 is vertically slidable within the interior wall 45. An internal set of projecting ribs or flanges 46 formed on the internal wall 45 provide an upper stop for limiting the upward travel of the valve actuator 31. A directly downward pressure on the concave rear corner 31*a* of the actuator 31 is effective to move the actuator in a downwardly direction, thereby causing liquid spray to be dispensed through the dispensing nozzle 32. However, as shown in FIG. 6 a downward force applied to the exterior end of dispensing nozzle 32 causes a bending or flexing of the dispensing nozzle at its reduced neck portion 32*a*, and it is totally ineffective for the purpose of moving the valve actuator 31 in the downward direction. The structure and operation of the dispensing nozzle 32 with its reduced neck portion 32*a* is described and claimed in a separate application filed concurrently with this present application and which is assigned to the same assignee as this application.

Further in accordance with the present invention a damper-like member 50 is provided which is povitally supported from one wall of the elongated passageway 41. The member 50 includes a hinge portion 51, a rear apron or handle portion 52, a closure portion 53, and a frontal portion 54. The handle portion 52 is essentially a linear extension of the closure portion 53, as is clearly seen in FIGS. 4 and 5. The frontal portion 54 extends upward at essentially a right angle to the closure portion 53.

Cover 40 is formed with a large opening 47 in the upper wall of passageway 41. Opening 47 is of a somewhat rectangular configuration but is arcuately curved somewhat throughout its length to conform with the passageway 41, as is most clearly seen in FIG. 4. A pair of ears 48 are formed on the lower corners of the opening 47. In the assembled condition of the device a pivot pin 5 is extended through both of the ears 48 and also through the elongated opening in the hinge portion 51 of the member 50, so as to pivotally support the member 50 about a pivot axis which extends traversely to the elongated passageway 41.

The damper-like member 50 is normally in the position shown in FIG. 4 in which it fully obstructs or closes the passageway 41. The forward portion 54 of the damper has a pair of forwardly projecting flange portions 57*a*, 57*b* formed on the upper extremity thereof. Flange portion 57*b* is relatively wide and is at all times disposed above the upper surface of cover 40, as will be seen both from the closed position of the damper as shown in FIG. 4 and from the open position of the damper as shown in FIG. 5. The flange 57*a* is of lesser width than flange 57*b*, and is spaced a small distance from it. In the closed position of the damper as shown in FIG. 4 the flange 57*a* is hooked beneath the wall of passageway 41 at the forward or upper end of the opening 47. Flange 57*a* therefore serves as a latch means which normally retains the damper-like member 50 in its passage-obstructing position. However, when the closure portion 53 is pushed upward by the finger 42 of the user, the entire damper pivots about the pivot pin 55 and the latch means 57*a* together with the associated forward wall 54 of the damper is forced to yield and bend somewhat and thereby permit its upward passage to its open position as shown in FIG. 5. Since the damper 50 is made of plastic material having a considerable degree of resilience, the bending or yielding movement of the forward portion 54 of the damper together with the latching flange 57*a* are achieved in response to a relatively modest amount of finger pressure applied by the user of the aerosol package.

Side walls 56 of damper 50 assist in supporting the forward portion 54 from closure portion 53.

ALTERNATE FORMS

Figure 10:
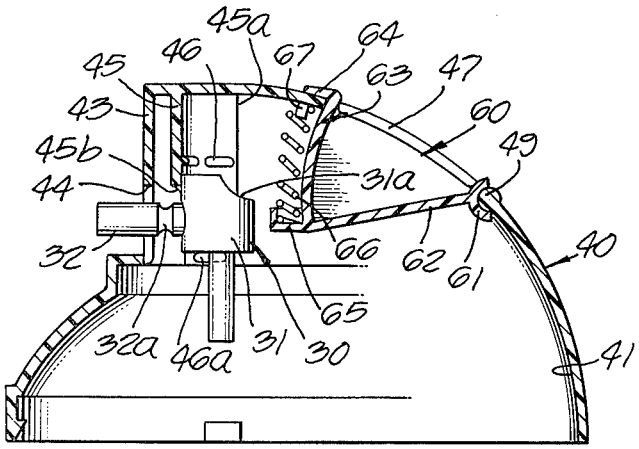
FIG. 10 is a fragmentary cross-sectional view of an alternate form of the invention.
Figure 11:
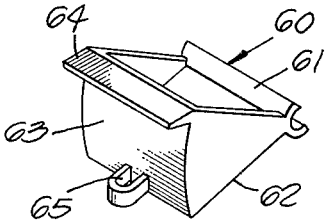
FIG. 11 is a perspective view of the damper of FIG. 10.

An alternate form of the invention is shown in FIGS. 10 and 11 wherein the damper has a somewhat different configuration and is identified by the reference numeral 60. The rearward portion 61 of the damper is a simple trough or semi-cylinder which rotates about a bead 49 formed on the lower end edge of opening 47. Closure portion 62 is similar to closure portion 53 of the prior version of the damper. The forward portion 63 of damper 60 is essentially perpendicular to the closure portion 62, but has a vertical dimension which is significantly less than the vertical dimension of the corresponding portion 54 of the first embodiment. Thus as seen in FIG. 10 the damper in its closed position does not completely obstruct the passageway 41, but does effectively block finger access to the actuating surface 31*a* of the valve actuator 31. The upper flange 64 of damper 60 effectively hooks over the upper surface of cover 40, the same as flange 57*b* of the prior embodiment.

In addition in the embodiment of FIGS. 10 and 11 there is a cup-like projection 65 formed on the forward end of the damper. The lower end of a compression spring 66 is placed within the cup 65. The upper end of the spring 66 engages a locating shaft 67 on the undersurface of the upper wall of cover 40. The finger of the user, must therefore, move the damper 60 in a pivotal upward movement against the force of compression spring 66, in order to obtain access to the valve actuator 31. When the dispensing action is completed and the finger of the user is removed, spring 66 automatically returns the damper 60 to its closed position.

The manner in which the valve actuator or pushbutton 31 is supported constitutes a further embodiment of the present invention. The housing 40 has a generally horizontal top wall 40*a* which, in the assembled condition as shown in FIG. 4, is disposed above the radial center of container 20. Wall portion 45 depends downwardly from top wall 40*a*. In addition to the ribs 46 to limit upward travel of push button 31 there is also a set of lower ribs 46*a* projecting interiorly of the wall 45. A circumferential portion 45*a* of wall 45 is cut away to provide finger access to push button 31, and a slot or window 45*b* on the forward side of wall 45 allows nozzle 32 to protrude. The plastic parts 31, 45 are preferably assembled right after forming, when still quite resilient. When housing 40 is removed from container 20 the push button 31 comes with it, as shown in FIG. 10.

The invention has been described in considerable detail in order to comply with the patent laws by providing a full public disclosure of at least one of its forms. However, such detailed description is not intended in any way to limit the broad features or principles of the invention, or the scope of patent to be granted.

What is claimed is:

1. A child-safe container assembly comprising:

a container having closure means selectively actuable for releasing contents from said container;

cover means for said container defining an elongated passageway whose internal end communicates with said closure means and whose external end defines an aperture adapted for the insertion of a single finger of a user, the length of said passageway being such that the finger of an adult is able to reach said closure means but the finger of a young child is not long enough to do so; and a damper-like member pivotally supported from said cover means and normally obstructing said passageway whereby the finger of the user must move said damper-like member at least partially out of the way before being able to reach and actuate said closure means.

2. The assembly of claim 1 which further includes latch means normally retaining said damper-like member in its normal passage-obstructing position; said latch means being yieldable in response to pressure applied to said member.

3. The assembly of claim 1 which further includes compression spring means cooperatively associated with said member for automatically returning said member to its normal position when the finger of the user is removed from said passageway.

4. The container assembly of claim 1 wherein the pivotal axis of said damper-like member is disposed transverse to said passageway, said member extending from its pivotal axis toward the inner end of said passageway.

5. An aerosol cap assembly comprising:

a housing adapted to extend above and be secured to the upper end of an aerosol container, including a generally horizontal top wall disposed above the radial center of the container, said housing also having a generally cylindrical wall portion depending downwardly from said top wall thereof, said cylindrical wall portion having both upper and lower interiorly projecting rib means formed therein; and a push-button having generally the form of a cylindrical body, said push-button being disposed within said cylindrical wall portion and adapted for vertical reciprocating movement therein so that its upward movement is limited by said upper rib means and its downward movement is limited by said lower rib means;

one circumferential portion of said cylindrical wall being cut away to provide finger access to said pushbutton.

* * * * *